US006896500B2

(12) United States Patent
Ike et al.

(10) Patent No.: US 6,896,500 B2
(45) Date of Patent: May 24, 2005

(54) GEAR PUMP

(75) Inventors: Nobukazu Ike, Anjo (JP); Satoru Kasuya, Anjo (JP); Masaaki Nishida, Anjo (JP); Masahiro Hayabuchi, Anjo (JP)

(73) Assignee: Aisin AW Co., Ltd., Aichi-ken (JP)

( * ) Notice: Subject to any disclaimer, the term of this patent is extended or adjusted under 35 U.S.C. 154(b) by 0 days.

(21) Appl. No.: 10/473,886

(22) PCT Filed: Dec. 3, 2002

(86) PCT No.: PCT/JP02/12640

§ 371 (c)(1),
(2), (4) Date: Jan. 8, 2004

(87) PCT Pub. No.: WO03/048580

PCT Pub. Date: Jun. 12, 2003

(65) Prior Publication Data

US 2004/0202564 A1 Oct. 14, 2004

(30) Foreign Application Priority Data

Dec. 3, 2001 (JP) ..... 2001-368872

(51) Int. Cl.[7] ..... F04C 2/00

(52) U.S. Cl. ..... 418/171; 418/15; 418/75; 418/78; 418/189

(58) Field of Search ..... 418/171, 166, 418/15, 75, 78, 189

(56) References Cited

U.S. PATENT DOCUMENTS 5,413,470 A * 5/1995 Eisenmann ..... 418/171

FOREIGN PATENT DOCUMENTS

| | | | | |
|---|---|---|---|---|
| DE | 4227301 A1 | * | 2/1994 | ..... F04C/2/10 |
| JP | 61-061992 | * | 9/1984 | ..... F04C/2/10 |
| JP | 2588113 Y | | 10/1989 | |
| JP | 01273887 A | * | 11/1989 | ..... F04C/2/10 |
| JP | 2854903 B2 | | 11/1989 | |
| JP | 03189390 A | * | 8/1991 | ..... F04C/2/10 |
| JP | 05180174 A | * | 7/1993 | ..... F04C/15/04 |
| JP | 6-67876 U | | 9/1994 | |
| JP | 9-4569 A | | 1/1997 | |

* cited by examiner

*Primary Examiner*—Theresa Trieu
(74) *Attorney, Agent, or Firm*—Sughrue Mion, PLLC

(57) ABSTRACT

A bottom portion of an intake port is provided with a sloped bottom surface formed of a plane such that sloped bottom surface approaches the side surfaces of external teeth and internal teeth from an upstream side to a downstream side in rotational direction of two rotors. Fluid that flows in the intake port is regulated by the sloped bottom surface and smoothly guided into individual inter-teeth chambers that are expanding. Since the sloped bottom surface on the bottom portion of the intake port is formed of a plane without spiral or twisting, design and manufacturing of a gear pump is extremely easy.

24 Claims, 5 Drawing Sheets

GEAR PUMP

FIELD OF THE INVENTION

The present invention relates to a gear pump in which external teeth formed on an inner rotor are meshed with internal teeth formed on an outer rotor.

BACKGROUND OF THE INVENTION

There is a gear pump that sucks up fluid via an intake port using rotation of a pump rotor and discharges it to a discharge port. In a gear pump like this, when a rotational speed of the pump rotor increases, centrifugal action causes the fluid to easily flow in an outer peripheral side of the intake port and thus pressure in the outer peripheral side increases. On the other hand, the fluid does not easily flow in the inner peripheral side of the intake port, and pressure does not decrease. When a throttle becomes large immediately before an inter-teeth chamber is blocked from downstream edges of the intake port, cavitation easily occurs in the external teeth side. In a gear pump disclosed in U.S. Pat. No. 2,854,903, a bottom portion of the intake port is provided with a sloped bottom surface such that the intake port gradually becomes shallower from the upstream side to the downstream side of a fluid flow direction. Further, the sloped bottom surface is twisted three-dimensionally such that the intake port is deeper in the inner peripheral side which is closer to the central portion of the pump rotor and shallower in the outer peripheral side which is farther therefrom. Accordingly, the fluid is likely to flow in the inner peripheral side of the intake port, thereby preventing cavitation from occurring in the external teeth side of the inter-teeth chamber.

Meanwhile, a trochoid-type gear pump is disclosed in a gazette of Japanese Utility Model Registration No. 2588113. In this trochoid-type gear pump, in order to prevent cavitaion form occurring, a bottom portion of an intake port is provided with a sloped bottom surface such that the intake port becomes continuously shallower from the upstream side to the downstream side. Further, a shallow groove that runs continuously from the sloped bottom surface is formed at a downstream end portion of the intake port.

In the conventional gear pump disclosed in the aforementioned patent gazette, the sloped bottom surface provided on the bottom portion of the intake port is formed spiral from the upstream side to the downstream side in the fluid flow direction. Further, it needs to have a three-dimensionally twisted shape such that the intake port is deeper in the inner peripheral side which is closer to the central position of the pump rotor and shallower in the outer peripheral side which is farther therefrom. Therefore, design and manufacturing of the gear pump are complicated, and there is increase in cost.

Meanwhile, in the gear pump disclosed in the aforementioned gazette of the utility model, the downstream end portion of the intake port is provided with the shallow groove continuing from the sloped bottom surface so as to evenly cover an entire width of the intake port in the radial direction. Therefore, centrifugal action causes the fluid not to easily flow in the inner peripheral side of the intake port. It is not possible to solve the problem that pressure decreases in the external teeth side of the inter-teeth chamber, thereby cavitation easily occurring.

The present invention is devised in order to solve the aforementioned conventional problems, and an object thereof is to reliably prevent cavitation from occurring in an intake region of the gear pump with a simple structure.

DISCLOSURE OF THE INVENTION

The invention relates to a gear pump which rotatably houses, between a housing and a cover, an inner rotor which is coupled to a rotating shaft and which has external teeth on an outer periphery thereof, and an outer rotor having internal teeth that are meshed with the external teeth on an inner periphery thereof. Further, in this gear pump, an intake port is formed facing a region where inter-teeth chambers that are created between the external teeth and the internal teeth expand as rotation of both rotors advances, and a discharge port is formed facing a region where the inter-teeth chambers contract as rotation of both rotors advances. A sloped bottom surface provided on a bottom portion of the intake port is formed of a plane such that the sloped bottom surface approaches side surfaces of the internal teeth and the external teeth from the upstream side to the downstream side in the rotational direction of both rotors. Further, a downstream end segment of the sloped bottom surface is inclined such that an end of the segment which is farther from a rotational axis of the inner rotor is positioned upstream of an end of the segment which is closer thereto.

Accordingly, the gear pump sucks up fluid via an intake port in a region where the individual inter-teeth chambers that are created between the external teeth formed on the outer periphery of the inner rotor and the internal teeth formed on the inner periphery of the outer rotor and meshed with the external teeth expand as rotation of both rotors advances. Further, the gear pump discharges the fluid to the discharge port in a region where the inter-teeth chambers contract. The bottom portion of the intake port is provided with the sloped bottom surface formed of a plane which is inclined such that the sloped bottom surface approaches the side surfaces of the external teeth and the internal teeth from the upstream side to the downstream side in the rotational direction of both rotors. The fluid that flows in the intake port is regulated by the sloped bottom surface and smoothly guided into the inter-teeth chambers that are expanding. Since the bottom portion of the intake port is provided with the sloped bottom surface formed of a plane free from spiral or twisting, design and manufacturing of the gear pump become extremely easy. Further, the downstream end segment is inclined such that an end of the downstream end segment of the sloped bottom surface which is farther from the rotational axis of the inner rotor is positioned upstream of an end which is closer thereto. Therefore, the sloped bottom surface is shallower in the outer peripheral side in the radial direction than the inner peripheral side in the radial direction. Therefore, the flow rate in the inner peripheral side in the radial direction increases, and occurrence of cavitation can be prevented.

Further, in the aforementioned improved gear pump according to the invention, the sloped bottom surface is connected to a bottom surface adjourning the sloped bottom surface formed of a plane such that an upstream end segment constituting a starting portion of the sloped bottom surface is in parallel with the downstream end segment constituting the end portion of the sloped bottom surface. Therefore, the structure is simplified, the fluid flows smoothly, and design and manufacturing of the gear pump are easy.

Further, in the aforementioned improved gear pump according to the invention, the upstream end segment constituting the starting portion of the sloped bottom surface formed of a plane is perpendicular to the rotational axis. Therefore, when the sloped bottom surface is on the elongation line of the inner rotor radius, the sloped bottom surface is deeper in the inner peripheral side than the outer peripheral side in the radial direction. Accordingly, the fluid flow rate in the inner peripheral side in the radial direction is likely to increase. The thus increased flow rate is offset by urging force of the fluid in the inter-teeth chamber toward the external teeth side due to centrifugal force. The fluid that flows in the intake port is substantially evenly absorbed into the external teeth side and the internal teeth side of the individual inter-teeth chambers. Accordingly, the pressures in the individual inter-teeth chambers are maintained evenly in the intake region, and occurrence of cavitaion can be prevented.

Further, in the aforementioned improved gear pump according to the present invention, both the external teeth side and the internal teeth side of the inter-teeth chamber immediately before being blocked from the intake port are closed simultaneously by the downstream edge of the intake port. Accordingly, it is possible to prevent cavitation from occurring due to uneven decrease of the pressure either in the external teeth side or the internal teeth side in the inter-teeth chamber.

Moreover, in the aforementioned improved gear pump according to the invention a bottom portion in a section facing the internal teeth of the downstream end portion of the intake port is provided with a shallow bottom flat surface. The shallow bottom flat surface intersects the plane that constitutes the sloped bottom surface.

Accordingly, in the inter-teeth chamber immediately before being blocked from the intake port, the fluid that flows in is throttled by the downstream edge of the intake port. Thus, the fluid is urged to the internal teeth side by centrifugal force of the rotor. However, the fluid inflow from the intake port to the internal teeth side of the inter-teeth chamber is restricted by the shallow bottom flat surface formed in a portion facing the internal teeth of the downstream end portion of the intake port. Therefore, the fluid flow rate from the intake port to the external teeth side of the inter-teeth chamber increases, preventing the pressure in the external teeth side from decreasing. Accordingly, cavitation is reliably prevented.

Further, in the aforementioned improved gear pump according to the invention, a separation protrusion is provided protruding from the downstream end to the upstream side of the intake port. The separation protrusion separates the downstream end portion of the intake port into an inner end portion facing the external teeth and an outer end portion facing the internal teeth. The shallow bottom flat surface is formed such that its circumferential length gradually increases from the protrusion end portion to the radial outward of the separation protrusion. The plane is connected to the upstream edge of the shallow bottom flat surface along the downstream end segment.

Accordingly, the fluid that flows into the internal teeth side of the inter-teeth chamber immediately before being blocked from the intake port is restricted by the shallow bottom flat surface. Further, the fluid flows in from the inner end portion to the external teeth of the inter-teeth chamber. Therefore, it is possible to separate a control of the fluid inflow from the downstream end portion of the intake port to the inter-teeth chamber into a control of the internal teeth side and a control of the external teeth side. Further, the cavitaion that used to occur in the inner side of the external teeth can be prevented more reliably.

BEST MODE FOR CARRYING OUT THE INVENTION

Figure 1:
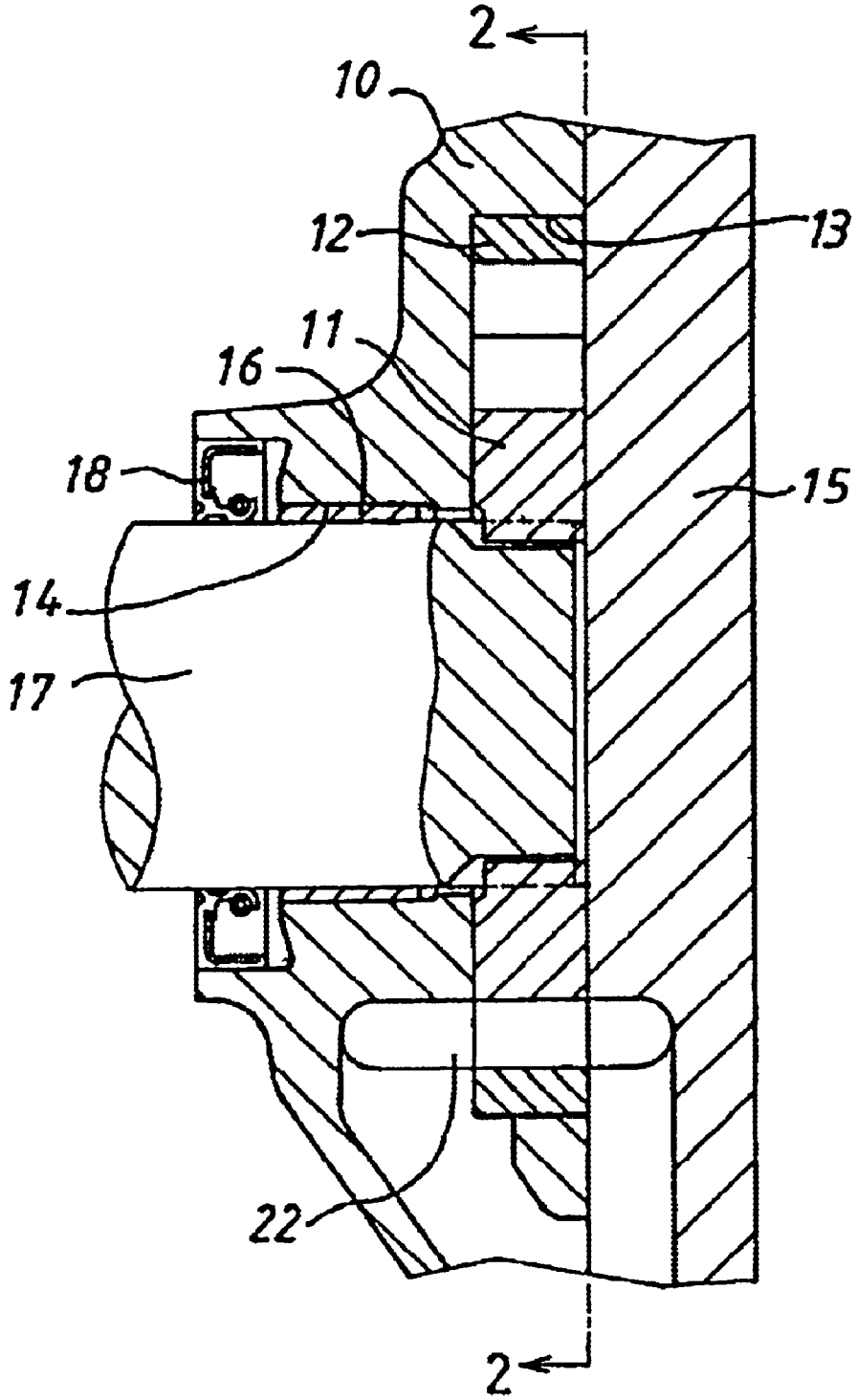
FIG. 1 is a side view of a gear pump according to an embodiment of the present invention.

Hereafter, an embodiment of the present invention employed in a gear pump that supplies an automatic transmission of an automobile with hydraulic oil will be referred to with reference to the drawings. As shown in FIG. 1, a flat side surface of a housing 10 is provided with a housing chamber 13, which has a circular shape and a certain depth and rotatably houses an inner rotor 11 and an outer rotor 12. A center hole 14 is opened in an inner bottom surface of the housing chamber 13. The center hole 14 pierces the housing 10 offset with respect to the center of the housing chamber 13 by the same amount as the offset amount between both rotors 11, 12. A cover 15 is fastened with a bolt to the housing 10 such that a flat side surface thereof covers the housing chamber 13 in a fluid-tight manner. Further, the inner rotor 11 is spline connected with a drive shaft 17 which is rotatably supported by the housing 10 using a bearing bush 16 pressed in the center hole 14. An oil seal 18 seals a gap between the drive shaft 17 and the housing 10.

External teeth 19 of such as trochoid tooth profile, involute tooth profile, or the like are formed on an outer periphery of the inner rotor 11. Internal teeth 20 having one more tooth than the external teeth 19 and being meshed with the external teeth 19 are formed on the inner periphery of the outer rotor 12. The outer rotor 12 is rotatably fitted into the housing chamber 13. The inner rotor 11 is housed in the housing chamber 13 in a state in which the external teeth 19 thereof are meshed with the internal teeth 20. Further, the inner rotor 11 is spline connected to the drive shaft 17. The side surfaces of the inner rotor 11 and the outer rotor 12 are covered with a bottom surface of the housing chamber 13 and a side surface of the cover 15 in a fluid-tight manner. Accordingly, the inner rotor 11 that is coupled to the drive shaft 17 and has the external teeth 19 and the outer rotor 12 having the internal teeth 20 meshed with the external teeth 19 are rotatably housed eccentrically between the housing 10 and the cover 15.

Figure 2:
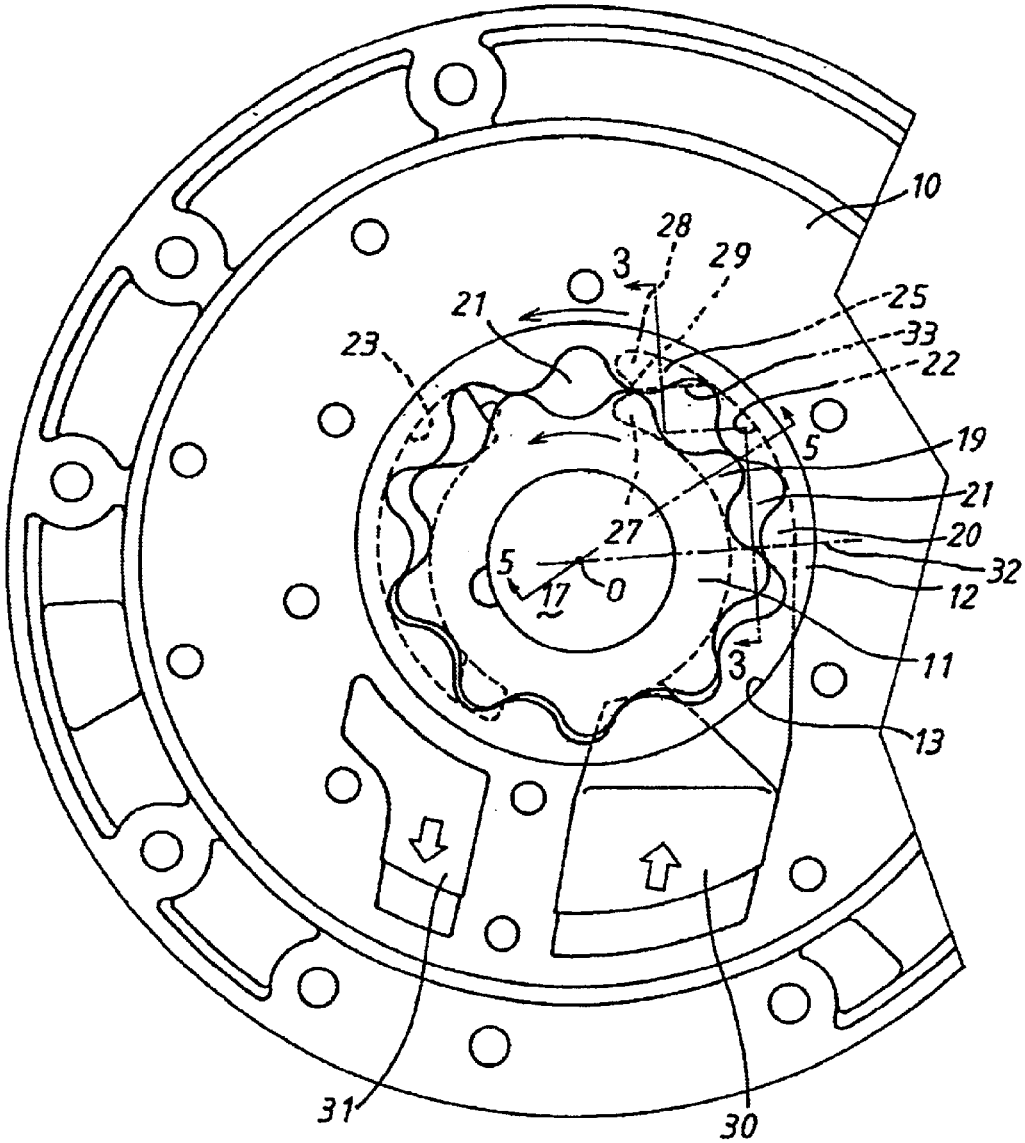
FIG. 2 is an arrow view of the gear pump cut along line 2—2 in FIG. 1.

As shown in FIG. 2, a plurality of inter-teeth chambers 21 are created between the individual external teeth 19 and the individual internal teeth 20. As rotation of the rotors advances, the volume of each inter-teeth chamber 21 increases in an intake region, that is, a forward region in the rotational direction of the rotors 11, 12. Further, the volume decreases in a discharge region, that is, a rearward direction. A bottom surface of the housing chamber 13 is provided with an arc-shaped intake port 22 facing the side surfaces of the external teeth 19 and the internal teeth 20 creating the inter-teeth chamber 21 in the intake region. Further, an arc-shaped discharge port 23 is provided facing the side surfaces of the external teeth 19 and the internal teeth 20 creating the inter-teeth chamber 21 in the discharge region. A termination end of the discharge region and a start end of the intake region are separated from each other at a separation region which is in the vicinity of contact points of a pitch circle of the external teeth 19 and a pitch circle of the internal teeth 20. A sealed region is provided at a portion which is 180° away from the separation region in the circumferential direction. In the sealed region, the inter-teeth chamber 21 that has expanded up to the maximum volume are blocked from the intake port 22 and the discharge port 23.

Figure 3:
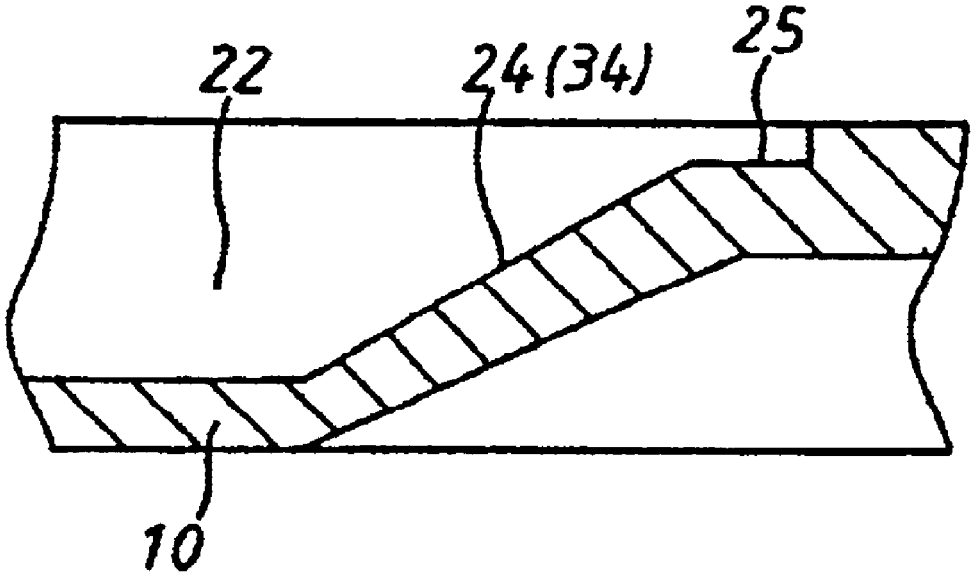
FIG. 3 is a sectional view of the gear pump cut along line 3—3 in FIG. 2.
Figure 4A:
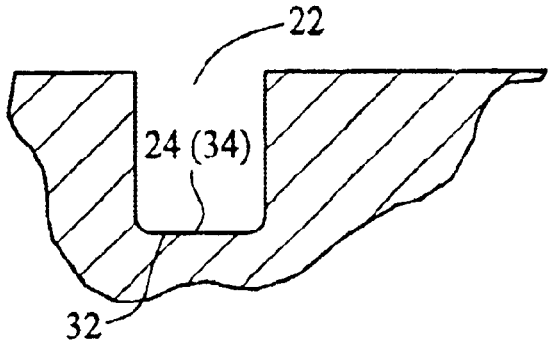
FIG. 4 is a sectional view of a sloped bottom surface cut along an upstream end segment (FIG. 4(*a*)), a downstream end segment (FIG. 4(*b*)), and a segment at a central portion (FIG. 4(*c*)).
Figure 4B:
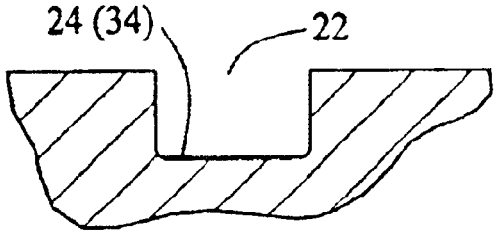
Figure 4C:
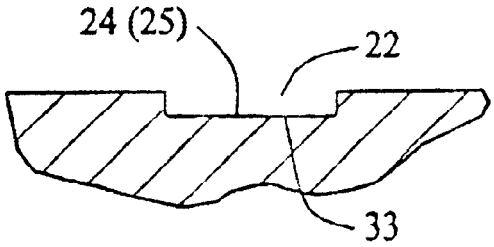

As shown in FIGS. 2, 3, the bottom portion of the intake port 22 is provided with a sloped bottom surface 24, ranging from the central portion to a vicinity of the terminal point of the intake region. The sloped bottom surface 24 is inclined such that the sloped bottom surface 24 approaches the side surfaces of the external teeth 19 and the internal teeth 20 and the intake port 22 becomes shallower from the upstream side to the downstream side in the rotational direction of both rotors 11, 12. The sloped bottom surface 24 is formed of a single plane 34. The single plane 34 extends between an upstream end segment 32 which constitutes a starting portion thereof and a downstream end segment 33 which is in parallel with the upstream end segment 32 and constitutes an end portion of the sloped bottom surface 24. Further, the sloped bottom surface 24 is inclined so as to approach the side surfaces of the external teeth 19 and the internal teeth 20 from the upstream side to the downstream side in the rotational direction of both rotors 11, 12. The upstream end segment 32 is perpendicular to a rotational axis O of the inner rotor 11. Each of FIGS. 4(*a*), (*b*), (*c*) is a sectional view of the sloped bottom surface 24 provided on the bottom portion of the intake port 22 cut along the upstream segment 32, the downstream segment 33, and a segment which is in parallel with the segments 32, 33 and exists in a central portion of the sloped bottom surface 24. As shown in these drawings, in any cross section, the segment that shows the bottom surface is in parallel with the upstream end segment 32, and the intake port 22 becomes shallower from the upstream side to the downstream side.

Figure 5:
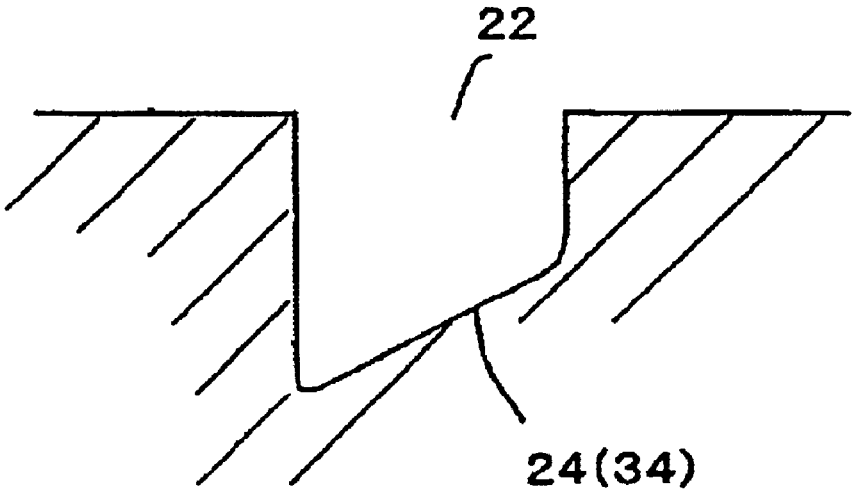
FIG. 5 is a partial sectional view of the gear pump cut along line 5—5 in FIG. 2.

FIG. 5 is a sectional view of the intake port 22 cut at the central portion of the sloped bottom surface 24 along a plane including a rotational center of the inner rotor 11. As apparent from FIG. 5, when the sloped bottom surface 24 is on the elongation line of the radius of the inner rotor 11, the sloped bottom surface 24 is deeper in the inner peripheral side than the outer peripheral side in the radial direction, as the sloped bottom surface 24 is separated from the upstream end segment 22 and approaches the downstream side. Accordingly, the fluid flow rate is likely to increase more in the inner peripheral side than in the outer peripheral side in the radial direction.

The bottom portion of a section facing the internal teeth 20A of the outer rotor 12 at the downstream end portion of the intake port 22 is provided with a shallow bottom flat surface 25 which is adjacent to the sloped bottom surface 24, and connected to the sloped bottom surface 24 along the downstream end segment 33. Further, the shallow bottom flat surface 25 is in parallel with rotational planes of the rotors 11, 12 with a slight gap with the side surfaces of the rotors 11, 12. A separation protrusion 29 is provided protruding from the downstream end toward the upstream end of the intake port 22. The separation protrusion 29 separates the downstream end portion of the intake port 22 into an inner end portion 27 and an outer end portion 28. The inner end portion 27 faces the external teeth 19 of the inner rotor 11, and the outer end portion 28 faces the internal teeth 20 of the outer rotor 12. The external teeth side and the internal teeth side of the inter-teeth chamber 21 are separated by the separation protrusion 29 as rotation of the rotors 11, 12 advances, and are facing the inner end portion 27 and the outer end portion 28, respectively. Further, the external teeth side and the internal teeth side of the inter-teeth chamber 21 which is immediately before being broken from the intake port 22 are closed simultaneously by the downstream edges of the inner end portion 27 and the outer end portion 28, as rotation of both rotors 11, 12 advances.

The shallow bottom flat surface 25 is formed such that its circumferential length gradually increases from the protrusion end portion of the separation protrusion 29 toward the radial outward thereof. The upstream edge of the shallow bottom flat surface 25 is connected to the sloped bottom surface 24 along the downstream end segment 33. Further, the shallow bottom flat surface 25 extends inclined to the outer side wall in the radial direction of the intake port 22 which is slightly downstream of the protrusion end portion of the separation protrusion 29. Specifically, the downstream end segment 33 is inclined such that an end of the downstream end segment 33 of the sloped bottom surface 24 which is farther from the rotational axis of the inner rotor 11 is positioned upstream of an end which is closer thereto. Further, the bottom surface ranging from the starting portion to the central portion of the intake region of the intake port 22 is formed of a plane which is in parallel with the rotating planes of the rotors 11, 12 and includes the upstream end segment 32. The intake port 22 is connected to an intake passage 30 provided in the housing 10 at the starting portion of the intake region. The intake passage 30 is communicated with a tank, not shown. The discharge port 23 is connected to an actuator via a discharge passage 31 provided in the housing 10.

Next, an operation of the gear pump according to the aforementioned embodiment will be explained. When the inner rotor 11 is rotated by the drive shaft 17, the outer rotor 12 is also rotated by the mesh of the external teeth 19 and the internal teeth 20. The volume of the inter-teeth chamber 21 in the intake region increased as rotation of the rotors 11, 12 advances. Then, the fluid from the tank passes through the intake passage 30, and is sucked via the intake port 22. Meanwhile, the volume of the inter-teeth chamber 21 in the discharge region contracts, and the fluid is discharged to the discharge port 23, and fed to the actuator via the discharge passage 31.

The fluid that flows in the intake port 22 is regulated by the sloped bottom surface 24 that is inclined such that the intake port 22 becomes shallower from the upstream side to the downstream side. Then the fluid is smoothly absorbed in each inter-teeth chamber 21 that is expanding. When the sloped bottom surface 24 of the intake port 22 is on the elongation line of the radius of the inner rotor 11, the sloped bottom surface is deeper in the inner peripheral side than the outer peripheral side in the radial direction. Therefore, the fluid flow rate in the intake port 22 is likely to increase in the inner peripheral side in the radial direction. This increase offsets an urging force of the fluid in the inter-teeth chamber 21 toward the external teeth side caused by centrifugal force generated by rotation of the rotors 11, 12. Accordingly, the fluid that flows in the intake port 22 is substantially evenly absorbed into the external teeth side and the internal teeth side of each inter-teeth chamber. Therefore, pressures in individual inter-teeth chambers in the intake region are maintained evenly, and occurrence of cavitation in the external teeth side can be prevented in the inter-teeth chamber 21.

The fluid flows in the external teeth side of the inter-teeth chamber 21 immediately before being blocked from the intake port 22 via the inner end portion 27 of the intake port 22 which is separated by the separation protrusion 29.

Meanwhile, the fluid flows in the internal teeth side from the outer end portion 28, separated from the fluid flowing into the external teeth side. At this time, the fluid that flows in the external teeth side and the fluid that flows in the internal teeth side of the inter-teeth chamber 21 are throttled by downstream edges of the inner end portion 27 and the outer end portion 28 of the intake port 22, respectively. Further, the fluid in the inter-teeth chamber 21 is urged by the centrifugal force generated by rotation of both rotors 11, 12 toward the external teeth side. Therefore, the pressure in the external teeth side of the inter-teeth chamber 21 is likely to decrease. However, the fluid that flows in the internal teeth side of the inter-teeth chamber 21 via the outer end portion 28 is restricted by the shallow bottom flat surface 25. Therefore, the flow rate of the fluid that flows into the external teeth side of the inter-teeth chamber 21 via the inner end portion 27 increases, thereby preventing decrease in the pressure in the external teeth side and cavitation does not occur. Further, as rotation of both rotors 11, 12 advances, the external teeth side and the internal teeth side of the inter-teeth chamber 21 are closed substantially simultaneously by downstream edges of the inner end portion 27 and the outer end portion 28, respectively. Therefore, pressure neither in the external teeth side nor the internal teeth side does not unevenly decrease.

In the embodiment mentioned above, the shallow bottom flat surface 25 is formed only in the outer end portion 28 of the intake port 22. However, it is possible to form a shallow bottom plane with a small circumferential length also in the inner end portion 27 so as to regulate the inflow resistance of the fluid to the internal teeth side of the inter-teeth chamber 21. Further, in the aforementioned embodiment, the shallow bottom flat surface 25 is provided in parallel with the rotating planes of both rotors 11, 12. However, the shallow bottom flat surface 25 may be slightly inclined such that the fluid inflow toward the internal teeth side of the inter-teeth chamber 21 can be restricted.

Further, the present invention may be applied to a gear pump in which a crescent shaped partition is interposed between the external teeth 19 of the inner rotor 11 and the internal teeth 20 of the outer rotor 12 in the sealed region raging between the terminal portion of the intake port 22 and the starting end of the discharge port 23.

INDUSTRIAL AVAILABILITY

A gear pump according to the present invention is suitable for use as a pump that serves as a hydraulic pressure source for operating a brake and a clutch for establishing each speed shift in an automatic transmission to be mounted on an automobile.

What is claimed is:

1. A gear pump in which an inner rotor which is coupled to a rotating shaft and which has external teeth on an outer periphery thereof, and an outer rotor having internal teeth on an inner periphery thereof that are meshed with the external teeth are rotatably housed between a housing and a cover, and inter-teeth chambers are created between the external teeth and the internal teeth, an intake port is formed facing a region in which the inter-teeth chambers expand as rotation of both rotors advances, and a discharge port is formed facing a region in which the inter-teeth chambers contract as rotation of both rotors advances, characterized in that a sloped bottom surface provided on a bottom portion of the intake port is formed of a plane that is inclined so as to approach a side surface of the internal teeth and the external teeth from the upstream side to the downstream side in the rotational direction of both rotors, and a downstream end segment of the sloped bottom surface is inclined such that an end of the downstream end segment of the sloped bottom surface which is farther from a rotational axis of the inner rotor is positioned upstream of an end which is closer thereto.

2. The gear pump according to claim 1, characterized in that an upstream end segment that constitutes a starting portion of the sloped bottom surface and the downstream end segment that constitutes a termination portion are in parallel with each other.

3. The gear pump according to claim 2, characterized in that the upstream end segment of the sloped bottom surface is perpendicular to a rotational axis of the inner rotor.

4. The gear pump according to claim 3, characterized in that both the external teeth side and the internal teeth side of the inter-teeth chamber immediately before being blocked from the intake port are closed simultaneously by a downstream edge of the intake port as rotation of both rotors advances.

5. The gear pump according to claim 4, characterized in that a bottom portion of a section facing the internal teeth of the downstream end portion of the intake port is provided with a shallow bottom flat surface intersecting a plane constituting the sloped bottom surface.

6. The gear pump according to claim 5, characterized in that a separation protrusion is provided from the downstream end to the upstream side of the intake port, separating the downstream end portion of the intake port into an inner end portion facing the external teeth and an outer end portion facing the internal teeth, the shallow bottom flat surface is formed such that its circumferential length gradually increases from the protrusion end portion toward the radial outward of the separation protrusion, and the plane is connected to the upstream edge of the shallow bottom flat surface along the downstream end segment.

7. The gear pump according to claim 3, characterized in that a bottom portion of a section facing the internal teeth of the downstream end portion of the intake port is provided with a shallow bottom flat surface intersecting a plane constituting the sloped bottom surface.

8. The gear pump according to claim 7, characterized in that a separation protrusion is provided from the downstream end to the upstream side of the intake port, separating the downstream end portion of the intake port into an inner end portion facing the external teeth and an outer end portion facing the internal teeth, the shallow bottom flat surface is formed such that its circumferential length gradually increases from the protrusion end portion toward the radial outward of the separation protrusion, and the plane is connected to the upstream edge of the shallow bottom flat surface along the downstream end segment.

9. The gear pump according to claim 2, characterized in that both the external teeth side and the internal teeth side of the inter-teeth chamber immediately before being blocked from the intake port are closed simultaneously by a downstream edge of the intake port as rotation of both rotors advances.

10. The gear pump according to claim 9, characterized in that a bottom portion of a section facing the internal teeth of the downstream end portion of the intake port is provided with a shallow bottom flat surface intersecting a plane constituting the sloped bottom surface.

11. The gear pump according to claim 10, characterized in that a separation protrusion is provided from the downstream end to the upstream side of the intake port, separating the downstream end portion of the intake port into an inner end portion facing the external teeth and an outer end portion facing the internal teeth, the shallow bottom flat surface is formed such that its circumferential length gradually increases from the protrusion end portion toward the radial outward of the separation protrusion, and the plane is connected to the upstream edge of the shallow bottom flat surface along the downstream end segment.

12. The gear pump according to claim 2, characterized in that a bottom portion of a section facing the internal teeth of the downstream end portion of the intake port is provided with a shallow bottom flat surface intersecting a plane constituting the sloped bottom surface.

13. The gear pump according to claim 12, characterized in that a separation protrusion is provided from the downstream end to the upstream side of the intake port, separating the downstream end portion of the intake port into an inner end portion facing the external teeth and an outer end portion facing the internal teeth, the shallow bottom flat surface is formed such that its circumferential length gradually increases from the protrusion end portion toward the radial outward of the separation protrusion, and the plane is connected to the upstream edge of the shallow bottom flat surface along the downstream end segment.

14. The gear pump according to claim 1, characterized in that an upstream end segment of the sloped bottom surface is perpendicular to the rotational axis of the inner rotor.

15. The gear pump according to claim 14, characterized in that both the external teeth side and the internal teeth side of the inter-teeth chamber immediately before being blocked from the intake port are closed simultaneously by a downstream edge of the intake port as rotation of both rotors advances.

16. The gear pump according to claim 15, characterized in that a bottom portion of a section facing the internal teeth of the downstream end portion of the intake port is provided with a shallow bottom flat surface intersecting a plane constituting the sloped bottom surface.

17. The gear pump according to claim 1, characterized in that a separation protrusion is provided from the downstream end to the upstream side of the intake port, separating the downstream end portion of the intake port into an inner end portion facing the external teeth and an outer end portion facing the internal teeth, the shallow bottom flat surface is formed such that its circumferential length gradually increases from the protrusion end portion toward the radial outward of the separation protrusion, and the plane is connected to the upstream edge of the shallow bottom flat surface along the downstream end segment.

18. The gear pump according to claim 14, characterized in that a bottom portion of a section facing the internal teeth of the downstream end portion of the intake port is provided with a shallow bottom flat surface intersecting a plane constituting the sloped bottom surface.

19. The gear pump according to claim 18, characterized in that a separation protrusion is provided from the downstream end to the upstream side of the intake port, separating the downstream end portion of the intake port into an inner end portion facing the external teeth and an outer end portion facing the internal teeth, the shallow bottom flat surface is formed such that its circumferential length gradually increases from the protrusion end portion toward the radial outward of the separation protrusion, and the plane is connected to the upstream edge of the shallow bottom flat surface along the downstream end segment.

20. The gear pump according to claim 1, characterized in that both the external teeth side and the internal teeth side of the inter-teeth chamber immediately before being blocked from the intake port are closed simultaneously by a downstream edge of the intake port as rotation of both rotors advances.

21. The gear pump according to claim 20, characterized in that a bottom portion of a section facing the internal teeth of the downstream end portion of the intake port is provided with a shallow bottom flat surface intersecting a plane constituting the sloped bottom surface.

22. The gear pump according to claim 21, characterized in that a separation protrusion is provided from the downstream end to the upstream side of the intake port, separating the downstream end portion of the intake port into an inner end portion facing the external teeth and an outer end portion facing the internal teeth, the shallow bottom flat surface is formed such that its circumferential length gradually increases from the protrusion end portion toward the radial outward of the separation protrusion, and the plane is connected to the upstream edge of the shallow bottom flat surface along the downstream end segment.

23. The gear pump according to claim 1, characterized in that a bottom portion of a section facing the internal teeth of the downstream end portion of the intake port is provided with a shallow bottom flat surface intersecting a plane constituting the sloped bottom surface.

24. The gear pump according to claim 23, characterized in that a separation protrusion is provided from the downstream end to the upstream side of the intake port, separating the downstream end portion of the intake port into an inner end portion facing the external teeth and an outer end portion facing the internal teeth, the shallow bottom flat surface is formed such that its circumferential length gradually increases from the protrusion end portion toward the radial outward of the separation protrusion, and the plane is connected to the upstream edge of the shallow bottom flat surface along the downstream end segment.

* * * * *